US005311199A

United States Patent [19]

Fraschilla et al.

[11] Patent Number: 5,311,199

[45] Date of Patent: May 10, 1994

[54] HONEYCOMB CROSS-POLARIZED LOAD

[76] Inventors: John Fraschilla, 125 S. Helberta #A, Redondo Beach, Calif. 90277; David A. Whelan, 10121 Laramie Ave., Chatsworth, Calif. 91311

[21] Appl. No.: 783,290

[22] Filed: Oct. 28, 1991

[51] Int. Cl.[5] ..... H01Q 13/10

[52] U.S. Cl. ..... 343/767; 343/841

[58] Field of Search ..... 343/767, 841, 795, 705, 343/770

[56] References Cited

U.S. PATENT DOCUMENTS

| | | | |
|---|---|---|---|
| 2,078,302 | 4/1937 | Wolff | 343/841 |
| 2,717,312 | 9/1955 | Taylor | 343/841 |
| 4,085,326 | 4/1978 | Williams | 350/339 |
| 4,697,190 | 9/1987 | Oswald | 343/719 |
| 4,978,965 | 12/1990 | Mohuchy | 343/767 |

*Primary Examiner*—Rolf Hille
*Assistant Examiner*—Hoanganh Le

[57] ABSTRACT

An impregnated carbon film expanded into a honeycomb structure is employed in a tapered notch phased array antenna and is used to absorb cross-polarized incident fields to reduce the reflections from shorted TEM parallel plate modes existing between radiator elements of the antenna. The carbon loading used to achieve this absorption may comprise a resistive taper, or analog circuit or anisotropic elements having a predetermined tapering resistive profile. The honeycomb cross-polarized load of the present invention provides the electrical performance necessary to meet tapered notch phased array antenna electrical requirements while reducing the weight and cost of antennas in which it is employed.

19 Claims, 2 Drawing Sheets

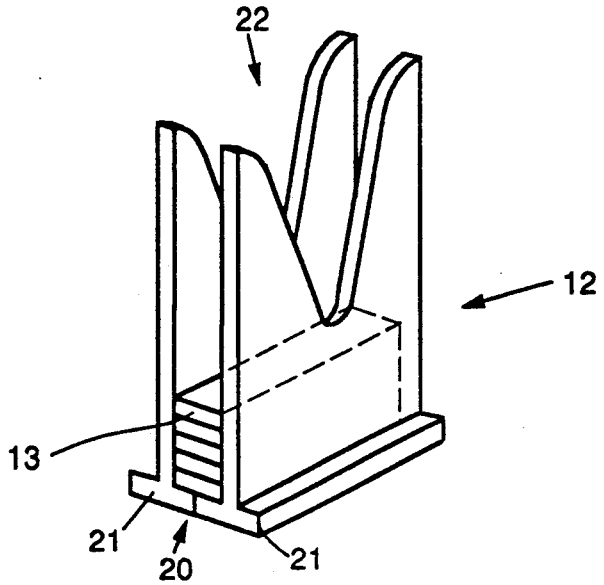
FIG. 4.
FIG. 5.
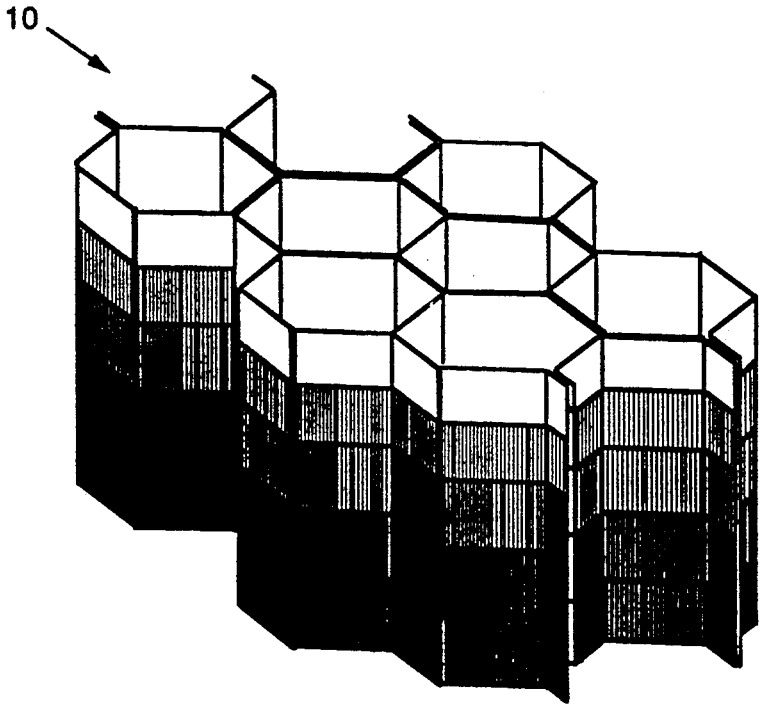

HONEYCOMB CROSS-POLARIZED LOAD

BACKGROUND

The present invention relates to ferrite load devices, and more particularly, to honeycomb cross-polarized loads for use in tapered notch phased array antennas.

The present approach of the assignee of the present invention to active phased array antenna technology employs the use of tapered notch radiators. Currently, a tapered ferrite load is used to absorb a cross-polarized field incident on the tapered notch radiators. Such conventional ferrite loads have been employed in trough regions between linear arrays of the tapered radiators that make up a phase array antenna, but it has been found that these components are relatively heavy due to their relatively high density.

It would therefore be an improvement in the art to have a component that is capable of absorbing the cross-polarized field incident on tapered notch radiators of a tapered notch phased array antenna that provides the same or improved performance when compared to conventional ferrite loads, but which reduces the weight and cost of the load.

SUMMARY OF THE INVENTION

In order to provide the above improvement, the present invention provides for a cross-polarization load for use in a tapered notch phased array antenna. The load comprises a honeycomb structure incorporating a carbon loaded film having a predetermined tapering resistive profile. The cross-polarization load is adapted to reduce the reflections from shorted TEM parallel plate modes existing in the trough region between radiator elements (or sticks) of the phased array antenna.

An impregnated carbon film expanded into a honeycomb structure is used to absorb the cross-polarized incident field in a tapered notch phased array antenna. The carbon loading used to achieve this absorption may comprise a resistive taper, analog circuit elements, or anisotropic elements having a predetermined tapering resistive profile. More particularly, a variety of grading techniques may be employed to form the film, including continuously variable grading, printing of cross-shaped elements, circularly-shaped elements, or rectangular elements, wherein the sizes of the elements increase along the length or width of the sheets.

The honeycomb cross-polarized load of the present invention provides the electrical performance necessary to meet tapered notch phased array antenna electrical requirements while reducing the weight and cost of antenna systems in which it is employed. The honeycomb cross-polarized load provides the same or improved performance over a conventional ferrite load while, drastically reducing the weight and cost of the load.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIG. 4 shows a portion of a flared notch antenna array that incorporates a cross-polarization load in accordance with the principles of the present invention; and FIG. 5 shows a detailed drawing of a typical honeycomb structure for use in the antenna array of FIG. 4.

DETAILED DESCRIPTION

Referring to the FIGS. 1–5, the present invention comprises a plurality of sheets 11 of carbon loaded film expanded into a carbon loaded honeycomb structure 10 that is used in a flared notch phased array antenna 12. The carbon loaded honeycomb structure 10 is used to absorb an incident cross-polarized field that irradiates the phased array antenna 12. The basic carbon loaded honeycomb structure 10 is manufactured by and is available from Hexcel Corporation, for example. However, the novel aspects of the present invention include the tapering of the carbon loading of the sheets 11, and the use of the carbon loaded honeycomb structure 10 within the structure of a flared notch phased antenna array 12.

Figure 1:
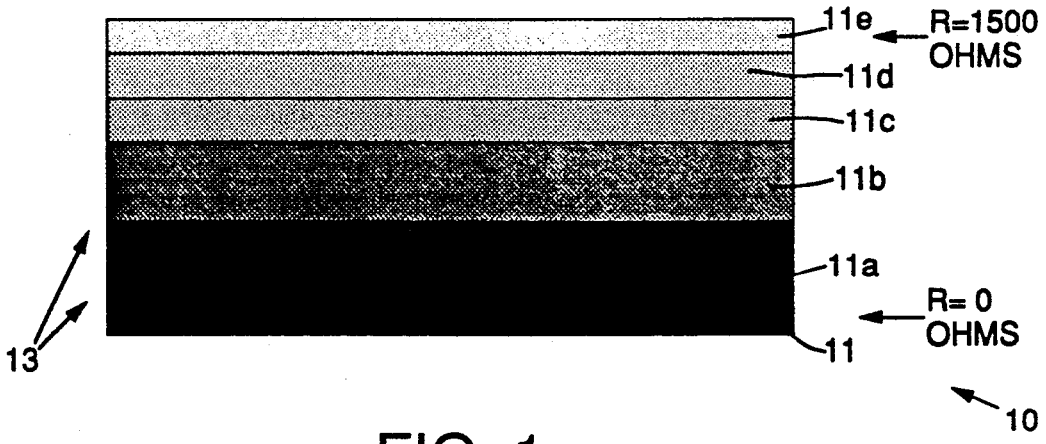
FIG. 1 shows a resistively loaded sheet for use in a honeycomb structure in accordance with the principles of the present invention.

FIG. 1 shows a first embodiment of a resistively loaded sheet 11 for use in the carbon loaded honeycomb structure 10 that is used in the flared notch phased array antenna 12. The carbon loaded honeycomb structure 10 incorporates tapered resistive loading in accordance with the principles of the present invention. The resistive loading and shape of this honeycomb structure 10 are configured to provide an absorbing transition to a shorted TEM parallel plate modes that exist in a trough region 22 of the flared notch phased array antenna 12 (shown in FIG. 4).

In order to fabricate the honeycomb structure 10, and with reference to FIG. 1, a plurality of sheets 11 of carbon loaded film, with each sheet 11 having a different resistive load illustrated by areas of differing resistive value 11*a*–11*e*, are glued together then expanded into the honeycomb structure 10. A typical expanded honeycomb structure 10 is shown in more detail in FIG. 5, with the shading in the figure representing the resistive taper. In the case of the resistive sheets 11 of FIG. 1, the particular resistances profiles of each of the respective sheets 11 and the total number of sheets 11 that are employed in a particular phased array antenna 12 are tailored based on the volume constraints and the frequency bandwidth of the radiating elements 21 in the antenna 12.

More particularly, and with reference to FIG. 1, a single sheet with a graded resistive profile may be achieved by varying the carbon loading across either or both linear directions of the sheet 11. Multiple sheets of identical or varying loading are then glued together and expanded into the honeycomb structure 10. The expanded honeycomb structure 10 is shown in more detail in FIG. 5.

Figure 2:
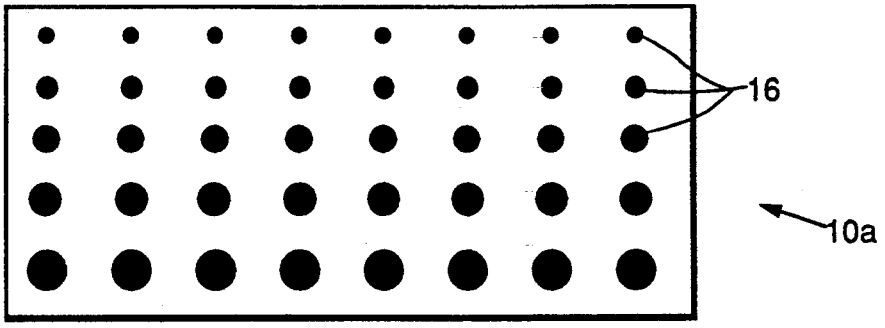
FIG. 2 shows a printed circuit loaded sheet for use in a honeycomb structure in accordance with the principles of the present invention.
Figure 3:
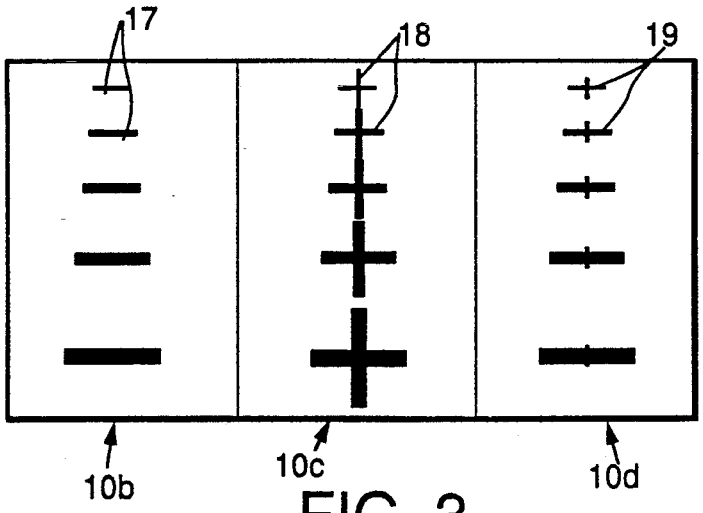
FIG. 3 shows a sheet having alternative loading arrangements disposed thereon including dipoles, crossed dipoles, and anisotropic elements that may be employed in a honeycomb structure in accordance with the principles of the present invention.

A variety of grading techniques and cell configurations may be employed to form a desired permittivity profile and polarization dependence. Carbon loading in either a continuous or step manner or carbon printed circuits are used to obtain the desired material performance. Such grading techniques include continuously variable grading, printing of cross-shaped elements, circularly-shaped elements, rectangular elements, or anisotropic elements, or the like, on the sheets 11*a*–11*e*, wherein the sizes of the elements increase along the length or width of the sheets 11*a*–11*e*. In the cases of the continuously variable grading technique, and the printing of the cross-shaped elements, circularly-shaped elements, rectangular elements, and anisotropic elements, each sheet 11 is loaded to have a resistance varying from 0 ohms to 1500 ohms from one edge of the sheet 11 to the other, for example, as is illustrated in FIGS. 1–3. In these alternative cases, the resistance profile of each of the respective sheets 11 and the total number of sheets 11 employed in a particular phased array antenna 12 are tailored based on the design specifications of the antenna 12.

Specific examples of the alternative grading techniques are shown in FIGS. 2 and 3. FIG. 2 shows a sheet 11 comprising printed circuit elements 16 for use in the honeycomb structure 10 of the present invention, while FIG. 3 shows a sheet having alternative loading arrangements disposed thereon including dipoles 17, crossed dipoles 18, and anisotropic elements 19 that may be employed in the honeycomb structure 10. A complete understanding of the construction details of the sheets 11 and the honeycomb structure 10 is available from Hexcel Corporation, the manufacturer of this product. However, for clarity, the sheets are bonded together and expanded into the honeycomb structure 10 depicted in more detail in FIG. 5.

With reference to FIG. 4, it shows a portion of the flared notch phased array antenna 12 that incorporates a cross-polarization load in accordance with the principles of the present invention. In order to fabricate the phased array antenna 12, the formed honeycomb structure 10 (having a selected type of loading and grading suitable for the particular antenna application) is then cut into strips 13, and the strips 13 are bonded between the individual H-plane spaced radiators 21 of the tapered notch phased array antenna 12, as is shown in FIG. 4. Alternatively, a section of the honeycomb structure 10 of FIG. 5 may be formed and bonded into the gap between the radiators 21.

The use of printed circuit elements 15, instead of tapering resistive strips 13, that provide for a tapered load is also a novel aspect of the present invention. More specifically, FIG. 2 shows a second embodiment of a honeycomb structure 10*a* that incorporates printed circuit loading in accordance with the principles of the present invention. The carbon in the second honeycomb structure 10*a* is loaded with printed circuit elements 16 having different resistance values. As in the case of the above-described first embodiment, sheets 11 of loaded carbon film having different printed circuit loads are glued together then expanded into the honeycomb structure 10*a*. The resulting honeycomb structure 10*a* is then cut into strips which are bonded between the H-plane spacing of the tapered notch array antenna 12, as is shown in FIG. 4, but wherein the printed circuit element honeycomb structure 10*a* is substituted for the one shown therein.

FIG. 3 shows third, fourth and fifth embodiments of honeycomb structures 10*b*, 10*c*, 10*d* that incorporates dipoles 17, crossed dipoles 18, and anisotropic elements 19, respectively, or other well-known types of graded films, in accordance with the principles of the present invention. The cell configuration of the honeycomb structure 10*a* incorporating the anisotropic elements 19 is constructed such that the polarization along a selected axis is different from that of an orthogonal axis. Typically, honeycomb structures 10*d* that provide anisotropic profiles may have a 2:1, 3:1, or 4:1 polarization ratio, for example, depending upon the design requirements of the phased FIG. 4 shows a perspective view of the flared notch phased array antenna 12 that incorporates a cross-polarization load 20 comprising resistive strips 13. The flared notch phased array antenna 12 comprises a plurality of tapered notch radiators 21 that are separated by a gap or trough region 22 into which the resistive strips 13 are disposed. Alternatively, the honeycomb structure 10 of FIG. 5 having any of the disclosed tapering load may be employed as the cross-polarization load 20 of the phased array antenna 12.

The resistive taper or printed circuit configuration of the flared notch cross-polarization load 20 serves as a good absorbing transition to the trough region 22 produced by H-plane stacking of E-plane linear arrays of tapered notch E-plane radiators 21. The resulting honeycomb cross-polarization load 20 has a density of approximately 0.05 to 0.1 grams/cc compared to about 3 grams/cc for a conventional ferrite load.

Thus there has been described new and improved tapered notch phased array antennas incorporating a variety of cross-polarized loads. It is to be understood that the above-described embodiments are merely illustrative of some of the many specific embodiments which represent applications of the principles of the present invention. Clearly, numerous and other arrangements can be readily devised by those skilled in the art without departing from the scope of the invention.

What is claimed is:

1. A cross-polarization load for use in a tapered notch phased array antenna having a plurality of substantially parallel tapered notch radiating elements, said load comprising:

a resistively tapering resistive element that is disposed between the radiating elements of the tapered notch phased array antenna that provides an absorbing transition to shorted TEM parallel plate modes present in a trough region between the radiating elements.

2. The cross-polarization load of claim 1 wherein the resistively tapering resistive element comprises a honeycomb structure having a resistively tapering resistive configuration.

3. The cross-polarization load of claim 2 wherein the honeycomb structure comprises a plurality of sheets of carbon loaded film expanded into a honeycomb structure.

4. The cross-polarization load of claim 3 wherein each sheet of carbon loaded film comprises a sheet of resistively tapering carbon loaded film.

5. The cross-polarization load of claim 4 wherein each sheet of carbon loaded film comprises a plurality printed circuit elements, with each element having a different resistive load.

6. The cross-polarization load of claim 5 wherein each sheet of carbon loaded film comprises dipole elements having different resistive loads.

7. The cross-polarization load of claim 5 wherein each sheet of carbon loaded film comprises crossed dipole elements having different resistive loads.

8. The cross-polarization load of claim 5 wherein each sheet of carbon loaded film comprises anisotropic elements having different resistive loads.

9. The cross-polarization load of claim 5 wherein the tapered notch phased array antenna comprises a plurality of substantially parallel E-plane linear arrays of tapered notch radiator elements stacked along their H-planes, and wherein the printed circuit elements provide an absorbing transition to the trough region produced by the H-plane stacking of the E-plane linear arrays.

10. The cross-polarization load of claim 4 wherein the tapered notch phased array antenna comprises a plurality of substantially parallel E-plane linear arrays of tapered notch radiator elements stacked along their H-planes, and wherein the resistively tapering resistive element provides an absorbing transition to the trough region produced by the H-plane stacking of the E-plane linear arrays.

11. A tapered notch phased array antenna comprising:

a plurality of substantially parallel tapered notch radiator elements disposed in an array such that a trough region is formed between adjacent radiator elements;

a resistively tapering resistive element disposed in the trough region that forms a resistively tapering cross-polarization load that provides an absorbing transition that reduces reflections from shorted TEM parallel plate modes existing between the radiator elements of the tapered notch phased array antenna.

12. The tapered notch phased array antenna of claim 11 wherein the resistively tapering resistive element comprises a honeycomb structure having a resistively tapering resistive profile.

13. The tapered notch phased array antenna of claim 12 wherein the honeycomb structure comprises a plurality of sheets of carbon loaded film expanded into a honeycomb structure.

14. The tapered notch phased array antenna of claim 13 wherein each sheet of carbon loaded film comprises a sheet of resistively tapering carbon loaded film.

15. The tapered notch phased array antenna of claim 14 wherein each sheet of resistively tapering carbon loaded film comprises a plurality of printed circuit elements, with each element having a different resistive load.

16. The tapered notch phased array antenna of claim 14 wherein each sheet of resistively tapering carbon loaded film comprises dipole elements having different resistive loads.

17. The tapered notch phased array antenna of claim 14 wherein each sheet of resistively tapering carbon loaded film comprises crossed dipole elements having different resistive loads.

18. The tapered notch phased array antenna of claim 11 wherein the resistively tapering resistive element comprises an anisotropic element.

19. The tapered notch phased array antenna of claim 12 wherein the honeycomb structure comprises an anisotropic element having a tapering resistive loading.

* * * * *